US005756996A

United States Patent [19]

Bier et al.

[11] Patent Number: 5,756,996

[45] Date of Patent: May 26, 1998

[54] ION SOURCE ASSEMBLY FOR AN ION TRAP MASS SPECTROMETER AND METHOD

[75] Inventors: Mark E. Bier, Pittsburgh, Pa.; John E. P. Syka, Sunnyvale, Calif.; Dennis M. Taylor, San Jose, Calif.; William J. Fies, Portola Valley, Calif.

[73] Assignee: Finnigan Corporation, San Jose, Calif.

[21] Appl. No.: 675,966

[22] Filed: Jul. 5, 1996

[51] Int. Cl.[6] ..... H01J 49/14; H01J 49/42

[52] U.S. Cl. ..... 250/292; 250/427; 250/286; 250/288

[58] Field of Search ..... 250/292, 427, 250/286, 288

[56] References Cited

U.S. PATENT DOCUMENTS 3,355,587 11/1967 Jenckel ..... 250/427

4,540,884 9/1985 Stafford et al. ..... 250/282

4,736,101 4/1988 Syka et al. ..... 250/292

5,015,848 5/1991 Bomse et al. ..... 250/288

*Primary Examiner*—Jack I. Berman

*Attorney, Agent, or Firm*—Flehr, Hohbach, Test, Albritton & Herbert LLP

[57] ABSTRACT

An external ion source assembly in which ion are formed in an ion volume by the interaction of energetic electrons and gas molecules. The effective energy of the electrons entering the ion volume is controlled by changing the voltage between the electron source (filament) and the ionization volume whereby ions having sufficient energy for ionizing atoms and molecules leave the electron source and enter the ionization volume only during an ionization period. The ion source assembly can be used both for electron impact ionization (EI) and for chemical ionization (CI).

6 Claims, 5 Drawing Sheets

ELECTRON ENERGY GATING SCHEME: POSITIVE EI

ION SOURCE ASSEMBLY FOR AN ION TRAP MASS SPECTROMETER AND METHOD

BRIEF DESCRIPTION OF THE INVENTION

This invention relates to an ion source assembly for ion trap mass spectrometers and to a method of operation of the ion source and more particularly, to an ion source in which the effective energy of ionizing electrons entering the ion source volume is lowered during non-ionization periods to eliminate neutral noise.

BACKGROUND OF THE INVENTION

Referring to FIG. 1, an ion trap mass spectrometer includes a ring electrode 11 and end caps 12 spaced from one another. An RF generator 14 applies an RF voltage to the ring electrode to supply an RF voltage between the end caps and the ring electrode to provide a substantially quadrupole field for trapping ions in the volume between the end caps and ring electrodes. A supplementary RF generator 17 is coupled to the end caps by the transformer 16 and supplies an axial RF voltage between the end caps. A heated filament 18 is held at a negative potential with respect to the ion trap DC or offset voltage. Electrons emitted by the filament are accelerated into the ion trap and through an opening in the end cap 12. The electrons are gated into the ion volume by a gate electrode 19 so that molecules or atoms are ionized in the interior of the ion trap only during ionization of the sample molecules introduced into the ion trap volume. As is well known, the amplitude of the fundamental RF voltage is scanned to bring successive ions formed in the ion trap into resonance with the supplementary RF field, the ion trajectories increase until they exit from the perforated end cap 12 and are detected by continuous dynode electron multiplier. The electron multiplier converts the ion current into an electrical signal which is plotted as a function of time to provide a mass spectrum. Operation of ion trap mass spectrometers is described in U.S. Pat. Nos. 4,540,884 and 4,736,101.

It has been found that the electron multiplier also produces electrical signals in a non-coherent manner during the entire period that the electron multiplier is energized. This is called "noise". Experiments have shown that the noise signal produced comes from two sources: ions produced external to the trapping volume by filament produced electrons and ions resulting from excited neutral particles striking the surface of the ion trap. Since the filament is always at a high negative potential (−70 ev), electrons emitted by the filament ionize gas molecules external to the trap. These ions do not enter the trapping volume because of repulsion by the gate electrode, but the ions can drift through the entire volume of the ion trap vacuum chamber 21. When they reach the area of the electron multiplier, they are accelerated to the multiplier surface by the high negative potential of the multiplier dynode and generate output noise signals. When large amounts of helium molecules are present, they are bombarded by the energetic electrons and they produce positive helium ions and also excited neutral molecules. These energetic particles hit surfaces with sufficient energy to sputter off adsorbed molecules/atoms, and ions.

It was realized that if the electron energy was reduced to below 14 electron volts, neither helium or excited neutral ions would be formed external to the trap because the electron energy is then too low to create such ion species. However, when these low energy electrons entered into the trapping volume they would pick up enough energy, during one-half of the RF cycle, and hence be able to have sufficient energy (30–130 ev) to efficiently ionize molecules within the trapping volume. This required building a special emission regulator to provide a constant electron emission by the filament at a filament bias voltage of about −12 v. The role of the grounded lens 22 is to isolate the filament region from the charging potential of the gate lens 19 to facilitating filament emission regulation. This worked very well allowing ion formation within the ion trap with a minimum noise because the electron energy external to the trap was not high enough to ionize helium atoms or create excited helium neutrals.

The foregoing solution applies only to internal ionization, where the RF ion trap voltage cooperates with the filament voltage to provide sufficient ionizing energy during one-half of the RF cycle. When an ion trap mass spectrometer is used to analyze the effluent from a gas chromatograph, it is advantageous that the ionization take place in an ionization volume which is external to the trapping volume. Ions which are formed are then transported into the ion trap with a multi-element system. One of the elements can be used as an ion gate, switching between two potentials, one which focuses ions into the trap and one which stops ion transmission. Such an gating arrangement is disclosed in co-pending application Ser. No. 08/647,297, filed May 9, 1996.

The original design of an external electron ionization (EI) source provided a continuous stream of electrons whereby ions were created at all times. Since the gas chromatograph was designed to direct effluent from the gas chromatograph directly into the source, there was always high pressure helium in the source. This resulted in the creation of excited neutrals. The output of the electron multiplier included noise from some of these excited neutrals which traveled from the source in a line of sight fashion through the ion trap to the vicinity of the electron multiplier where they struck surfaces and generate spurious ions.

OBJECTS AND SUMMARY OF THE INVENTION

It is an object of this invention to provide an external ion source in which the effects of neutral noise and external ions are minimized.

It is another object of the present invention to provide an external ion source in which the energy of electrons entering the ion source volume is sufficient to ionize molecules only during periods when ions are not being scanned out of the ion trap for detection and mass analysis.

It is yet another object of the present invention to provide an external ion source in which the energy of electrons entering the ion source volume is insufficient to excited helium atoms ions during periods when analytic ions are being analyzed.

It is a further object of the present invention to provide an external ion source, for an ion trap mass spectrometer, which can be operated by the electron impact ionization mode or the chemical ionization mode.

The foregoing and other objects of the invention are achieved by an external ionization source in which ions are formed in an ion volume by the interaction of energetic electrons and gas molecules (EI) or by the interaction of energetic electrons and a reagent gas with chemical ionization (CI) of the molecules/atoms. The effective energy of the electrons entering the ion volume is controlled by changing the voltage between the electron source (filament) and the ionization volume whereby electrons having sufficient energy for ionizing molecules leave the electron source and enter the ionization volume only during an EI or CI ionization period.

BRIEF DESCRIPTION OF THE FIGURES

The foregoing and other objects of this invention will be more clearly understood from the following drawings when read in conjunction the accompanying drawings, of which.

DESCRIPTION OF PREFERRED EMBODIMENTS

Figure 1:
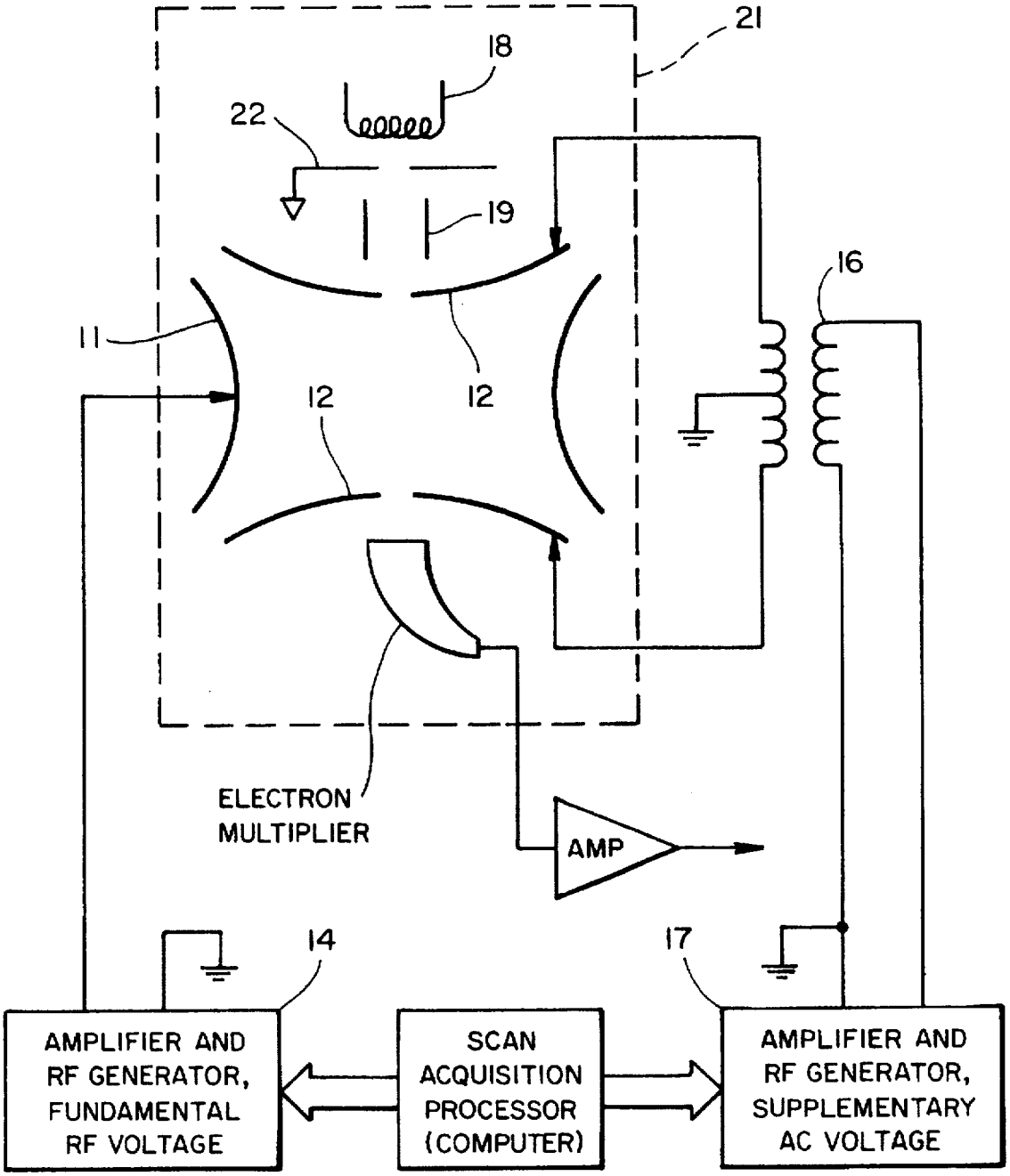
FIG 1 (PRIOR ART)
FIG. 1 is a schematic diagram of a prior art ion trap mass spectrometer.
Figure 2:
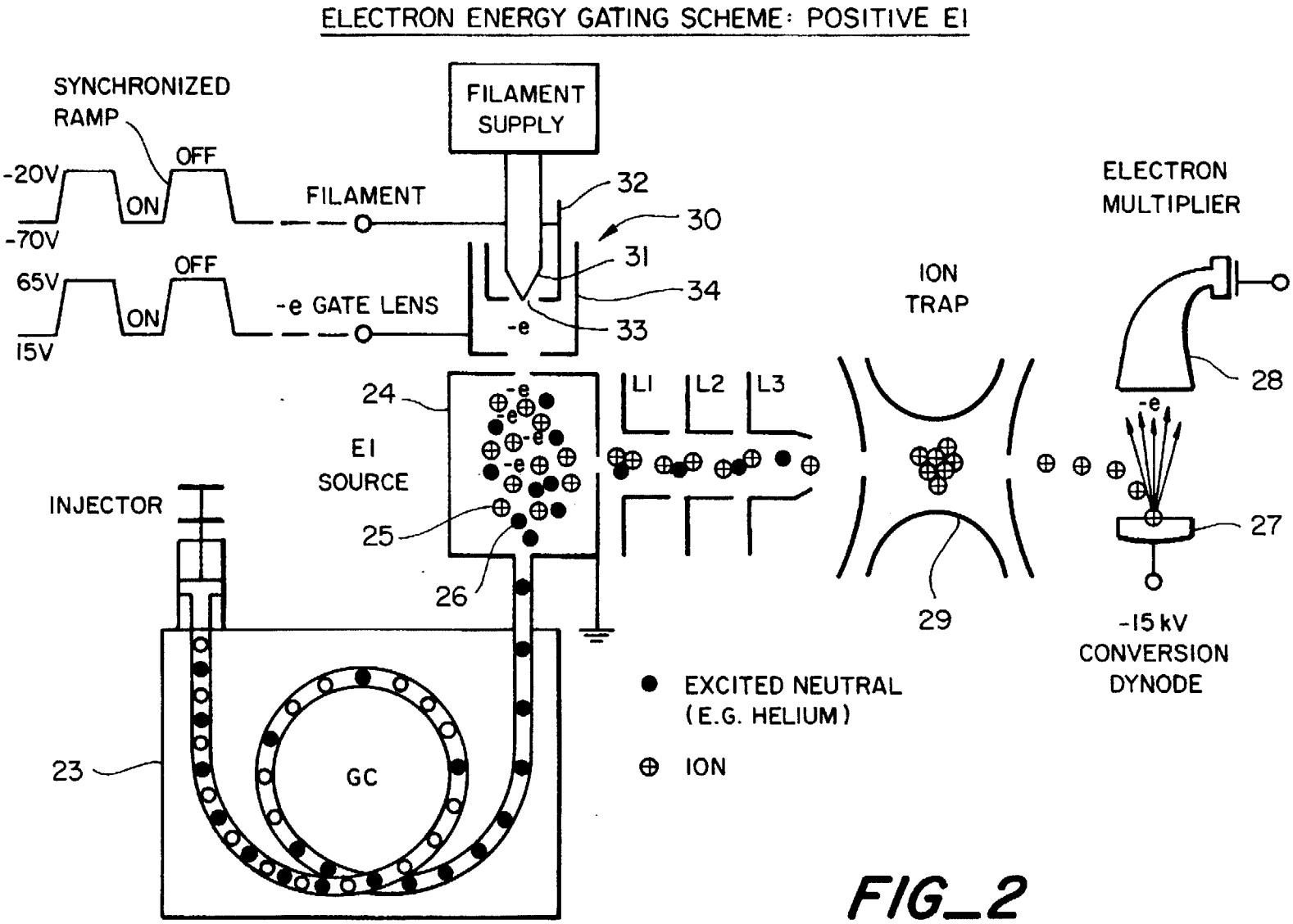
FIG. 2 is a schematic diagram of an ion trap mass spectrometer system, including an external ion source in accordance with the present invention, connected to a gas chromatograph for EI.

Referring to FIG. 2, a gas chromatograph 23 provides sample gas to an ion source 24. An electron source 23 provides energetic electrons to the ion source to ionize the atoms and molecules in said device and form positive ions 25 and excited neutrals 26. The ions and neutrals are guided or gated into the ion trap by the multi-element lens L1, L2, and L3 in a manner similar to that described in copending application Ser. No. 08/647,297 filed May 9, 1996. The ion trap 26 and its operation is as described above. The ejected ions are converted to electrons by conversion dynode 27 and multiplied by the electron multiplier 28 which provides the output electrical signal representative of the ion abundance.

Figure 3:
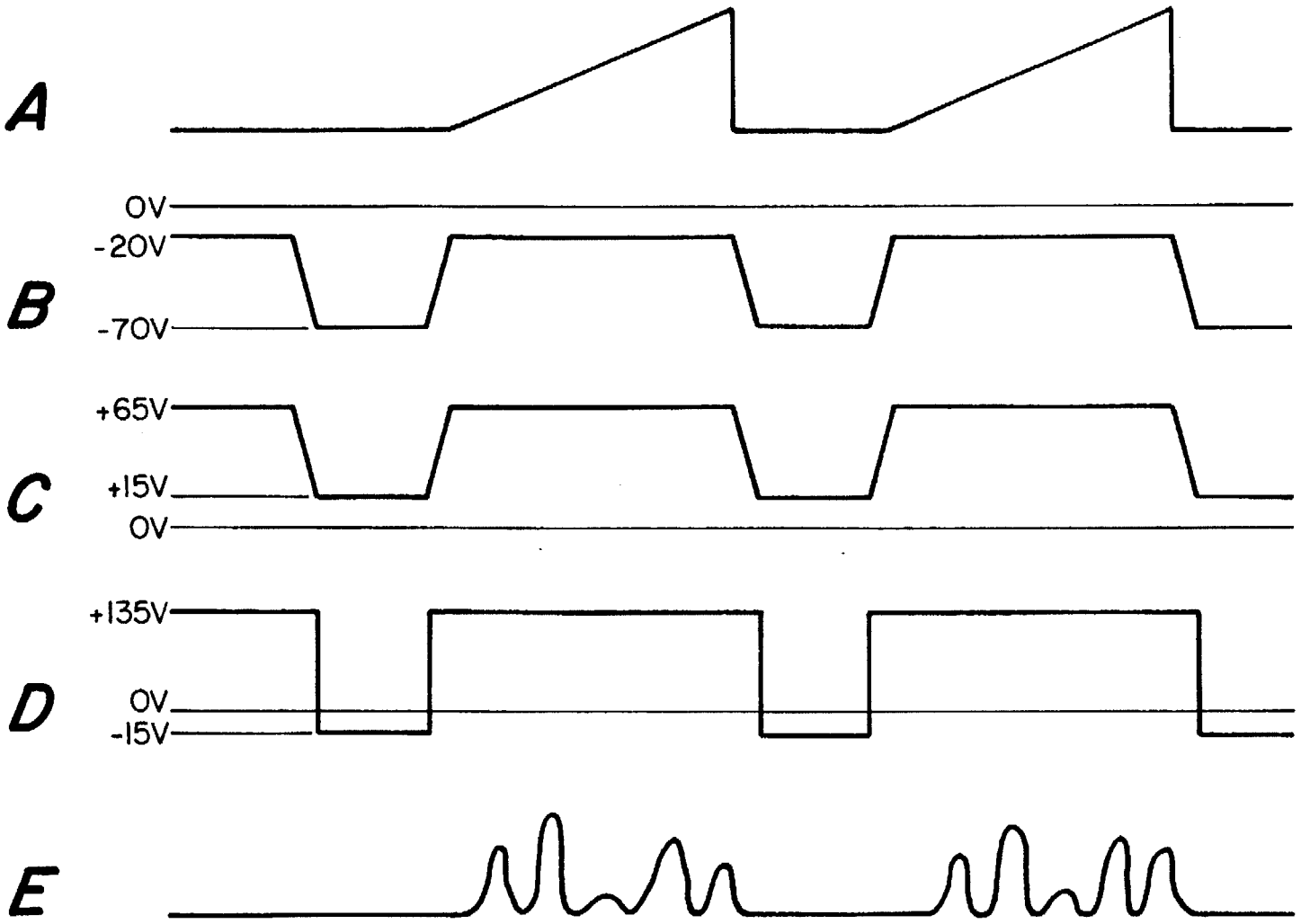
FIG. 3A–3E show timing diagrams illustrating the operation of the ion source and ion trap.

In accordance with the present invention, the energy of the electrons leaving the electron source and entering the ion source volume is controlled so that it is sufficient to ionize sample molecules and helium within the source volume only during the ionization time. The electron source includes a filament 31 which is heated to emit electrons. The filament may comprise a refractory material such as tungsten, rhenium or other alloy. The heating current supplied to the filament is preferably controlled to provide substantially constant emission. The grounded electrode 32 assures that emission of electrons is at the opening 33. The energy of electrons entering the ion source volume is controlled by the voltage between the filament and the ion source volume. Seventy electron volts has been found to be electron energy satisfactory for ionizing atoms and molecules. In accordance with the present invention, the filament voltage and/or excitation voltage is reduced to a voltage below the ionizing voltage for helium during nonionizing periods. FIG. 3A shows operation of the ion trap. The fundamental RF voltage is low as the ion trap is filled with sample ions. The voltage is then increase to provide a mass spectrum, FIG. 3E. Ions are formed and gated into the ion trap when the fundamental RF voltage is low. FIG. 3B shows the voltage applied to the filament from a voltage source (not shown) during ionization and during analysis. The voltage is at minus 70 volts during ionization thereby providing electrons having sufficient energy to ionize the sample molecules. During this period, the electron gate lens 34 is at a low positive voltage, for example 15 volts, FIG. 3C. During the analyzing cycle, the voltage applied to the filament by the source voltage is lowered to minus 20 volts. Electrons entering the ion source volume do not have sufficient energy to ionize sample or helium molecules and few, if any, excited ions are formed. The voltage on the gate lens 34 is increased to 65 volts. The voltage difference between the lens and filament is substantially constant. It is important that the potential difference between the filament and the gate lens remain substantially constant during the analysis cycle as this would perturb emission of electrons from the filament and defeat the regulation of emission. Thus, the filament sees substantially constant surrounds and the emission current can be regulated. During the ionization period, one of the lens L1, L2 or L3 is switched from a high positive potential, +135 v, to a low negative potential, −15 v, FIG. 3D, so as to prevent negative ions from entering the ion trap.

Figure 4:
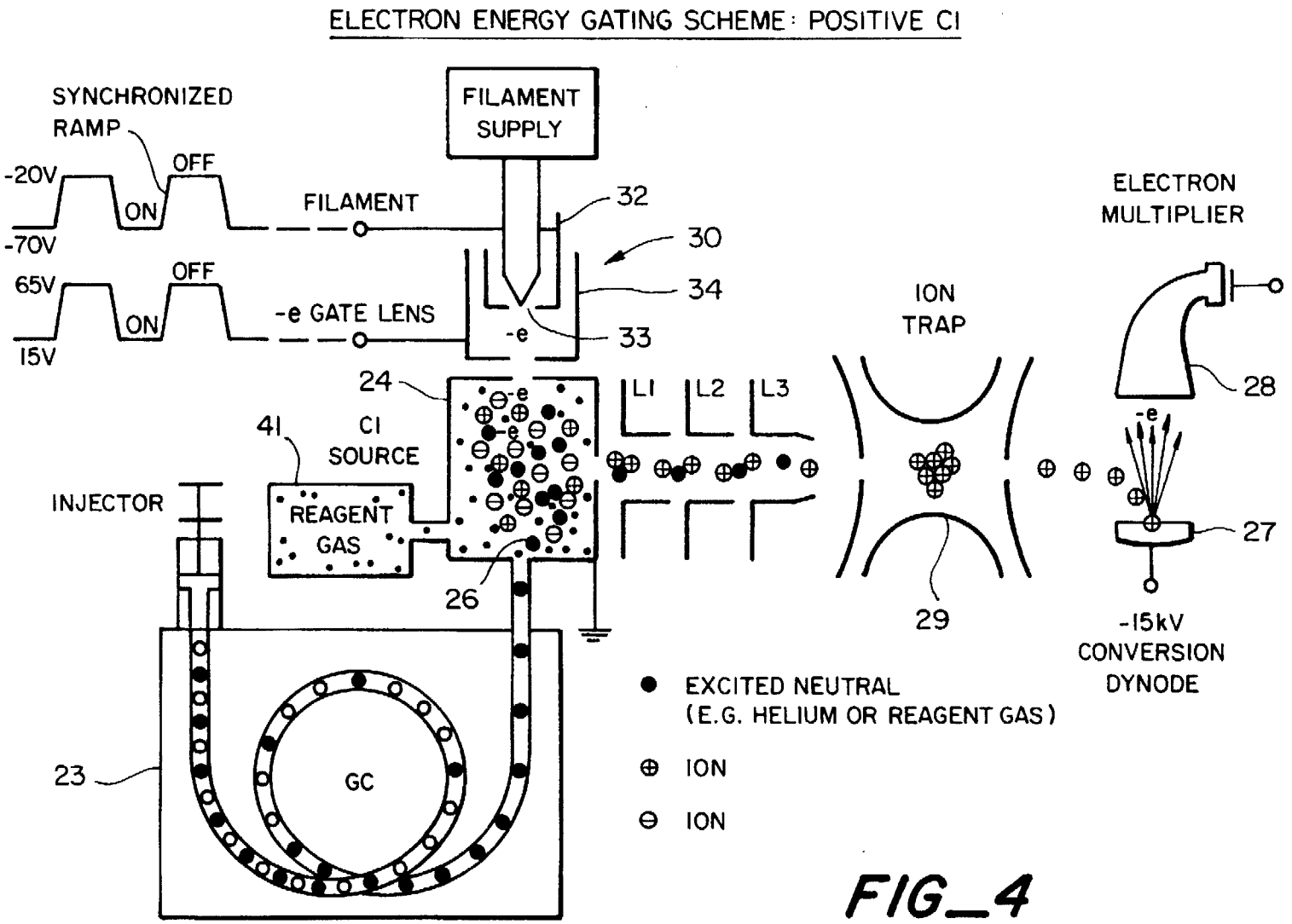
FIG. 4 is a schematic diagram of an ion trap mass spectrometer system, including an ion source in accordance with the present invention, connected to a gas chromatograph for detection of positive CI ions.
Figure 5:
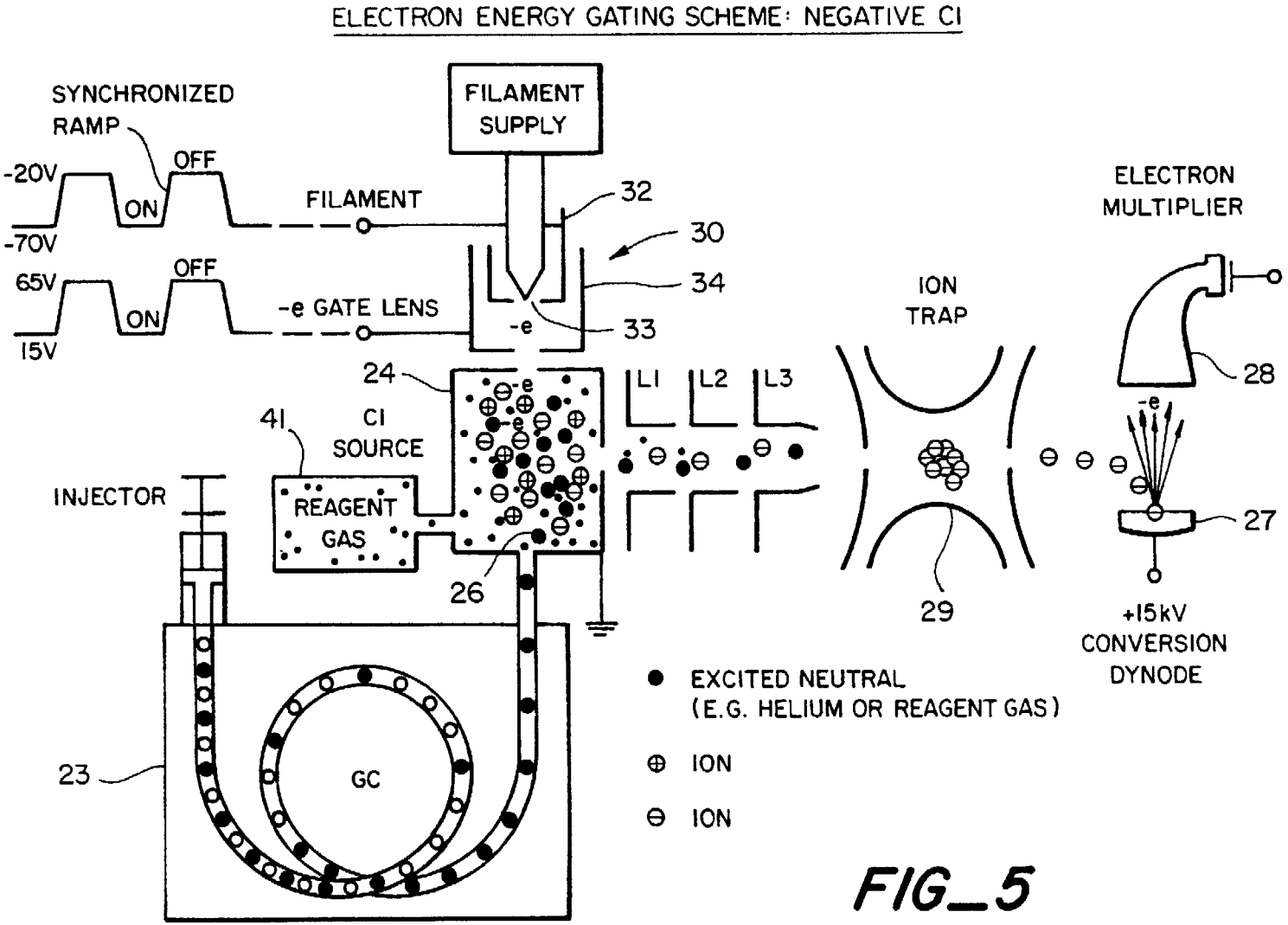
FIG. 5 is a schematic diagram of an ion trap mass spectrometer system, including an ion source in accordance with the present invention, connected to a gas chromatograph for detection of negative CI ions.

The ion source assembly just described can be used for chemical ionization (CI). Referring to FIGS. 4 and 5 where like reference numerals have been applied, a reagent gas 41 is introduced into the ion trap. The energetic electrons ionize the reagent gas and the reagent ions interact with the sample atoms and molecules to form positive and negative ions and excited neutrals (helium or reagent gas). During analysis, the electron energy is reduced as described above.

In order to analyze positive ions, the ion gate lens is switched from a high positive voltage to a negative voltage during ionization as described above. This gates positive ions into the ion trap during ionization, FIG. 4. If the gate lens voltages are reversed, negative ions are gated into the ion trap during ionization, FIG. 5.

Thus, there has been provided an improved ion source assembly in which neutral noise is minimized.

We claim:

1. An ion source assembly comprising:

an ion source;

an electron source for injecting electrons into said ion source to ionize atoms and molecules in said ion source;

said electron source comprising a filament and a lens electrode surrounding said filament;

a voltage source for supplying a negative voltage to said filament with respect to said ion source of a first value sufficient to ionize atoms and molecules during ionization and a negative voltage of a second value insufficient to ionize atoms and molecules during a non-ionization period; and, a voltage source for applying a first and second voltages to said lens during said ionization and non-ionization periods to maintain a substantially constant emission from said filament.

2. An ion source assembly as in claim 1 in which the first value of the negative voltage −70 v and the second value of said negative voltage is −20 v.

3. An ion source assembly as in claim 1 in which said electrons ionize sample molecules and atoms directly.

4. An ion source assembly as in claim 1 in which said electrons ionize reagent gas molecules and atoms to form ions which then ionize the sample molecules and atoms.

5. An ion trap mass spectrometer assembly including:

an ion source assembly as in claims 1, 2, 3 or 4;

an ion trap mass spectrometer; and, means for gating and generating ions of predetermined polarity from said ion source into said mass spectrometer during ionization to analysis.

6. An ion source assembly including:

an ion source;

an electron source for injecting electrons into said ion source; and, means for controlling the energy of the injected electrons so that the energy is sufficient to ionize atoms and molecules in said source during an ionizing period and insufficient to ionize or excite helium molecules at other times.

* * * * *